United States Patent [19]

Cotterell

[11] 3,946,501

[45] Mar. 30, 1976

[54] DRYING APPARATUS

[75] Inventor: Jeffrey Cotterell, Purley, England

[73] Assignee: E. T. Marler Ltd., London, England

[22] Filed: May 22, 1974

[21] Appl. No.: 472,309

Related U.S. Application Data

[63] Continuation of Ser. No. 224,675, Feb. 9, 1972, abandoned.

[52] U.S. Cl. ..... 34/155; 34/163; 34/216

[51] Int. Cl.[2] ..... F26B 13/00

[58] Field of Search ..... 34/23, 33, 162, 155, 160, 34/163, 216, 217; 248/239

[56] References Cited

UNITED STATES PATENTS

| | | | |
|---|---|---|---|
| 1,412,978 | 4/1922 | Sundh | 34/23 |
| 2,022,593 | 11/1935 | Fuykers | 34/23 |
| 2,157,309 | 5/1939 | Swedman et al. | 248/243 |
| 2,826,388 | 3/1958 | Janos et al. | 248/239 |
| 3,096,162 | 7/1963 | Jepson | 34/216 |

*Primary Examiner*—Carroll B. Dority, Jr.
*Assistant Examiner*—Larry I. Schwartz
*Attorney, Agent, or Firm*—Cushman, Darby & Cushman

[57] ABSTRACT

An air jet drying machine having a plenum chamber including a wall in which one or more apertures are formed. Heated air is supplied to the plenum chamber and passes out through the aperture or apertures to impinge on a web or sheet on a conveyor beneath the plenum chamber. The velocity at which air impinges upon the web or sheet may be adjusted by adjusting the mass rate of air flow into or out of the plenum chamber or, preferably, by varying the distance between the conveyor supporting the articles and the plenum chamber.

5 Claims, 6 Drawing Figures

DRYING APPARATUS

This is a continuation of application Ser. No. 224,675, filed Feb. 9, 1972, now abandoned.

The invention relates to jet air drying apparatus and in particular to means whereby optimum drying efficiency can be obtained under a variety of conditions and for different types of articles (e.g. printing stock) to be dried.

Jet air drying machines for the evaporative drying of ink on printed sheets are well known and widely used throughout the screen printing industry. Essentially, they comprise a conveyor belt which transports printed sheets under a plenum chamber from which air emerges through holes or slots and impinges on the wet ink to promote rapid evaporation of the ink solvents. The impinging air can be warm or cold and frequently both are sequentially employed. The warm air promotes more rapid evaporation and the cold air reduces the temperature of the sheets before they emerge from the dryer and are stacked.

The velocity of the impinging air is an important factor in the efficiency of such machines and in general, the higher the velocity at the point of impingement the more rapid is the rate of drying. However, excessively high air velocities can give rise to undesirable side effects when used with certain types of ink or sheets. For example, large areas of wet ink may be rippled and the dried surface of the print may be marred in consequence; thin sheets may be forced down into gaps between conveyor tapes or into the open areas of a mesh type conveyor belt and the dried sheet may be distorted: excessive flutter may develop on the sheet particularly if the edges are curled, and this may cause the sheet to lift and contact the underside of the plenum chamber resulting in smudging of the printed page.

According to this inventin an air jet drying machine comprises a plenum chamber including in a wall thereof one or more apertures, means for supporting an article to be dried adjacent the chamber, so that in use air issuing from the aperture impinges upon an article, and means for adjusting the velocity at which air impinges upon the said article.

The velocity of impingement may be varied by controlling the mass rate of flow of air to the plenum chamber and hence from the plenum chamber, or by varying the distance between the means for supporting an article to be dried and the plenum chamber, or by a combination of both.

According to a preferred embodiment of this invention an air jet drying machine comprises a plenum chamber including in a wall thereof one or more apertures, a conveyor for articles to be dried and located adjacent the chamber so that air issuing from the apertures is directed towards the conveyor, and means for effecting relative movement of the conveyor and at least part of the plenum chamber to vary the distance between the conveyor and the apertures.

Conveniently, the means for effecting the said relative movement comprises a means for raising and lowering at least one end of the conveyor.

One advantage of the invention is that thick or badly curled work pieces can be accommodated without fear of them scuffing or jamming on the underside of the plenum chamber by suitably varying the distance between the conveyor belt and the plenum chamber.

The invention will now be described by way of example, with reference to the accompanying drawings of which:

Figure 1:
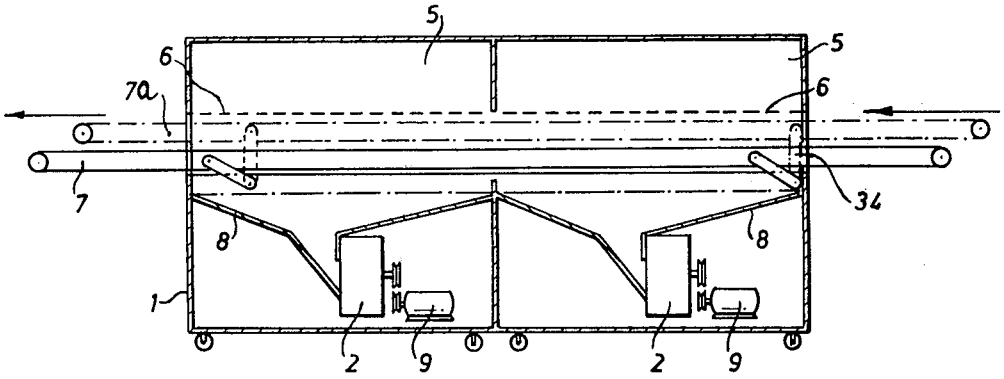
FIG. 1 shows a composite longitudinal section of an air jet drying machine.
Figure 2:
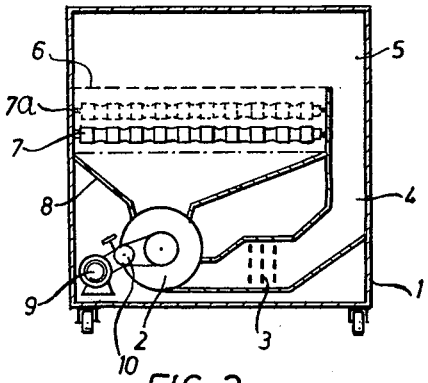
FIG. 2 shows a composite cross sectional view of the machine shown in FIG. 1.

In the embodiment shown in FIGS. 1 and 2, two drying stages are illustrated each of which is capable of supplying air at the same or at different temperatures and pressures. Each encased set of side frames 1 encloses a centrifugal fan 2 which blows air across a bank of heaters 3 and thence by way of ducts 4 to a plenum chamber 5. Air emerges from the plenum chamber 5 through holes or slots 6 set in the underside of the chamber and impinges on a web or sheet (not shown) which is carried through the machine by a conveyor belt 7.

The machine may include suction means for retaining the web or sheet on the conveyor as the web or sheet is carried by the conveyor into the plenum chamber to prevent lift and flutter of the web or sheet.

In the embodiment shown in FIG. 1 the fan is situated below the conveyor belt and spent air is collected and returned by way of duct 8 to the centrifugal fan 2 and recycled. In this case the suction means may comprise adjustable means provided in the region where the conveyor enters the plenum chamber for controlling the passage of spent air from the plenum chamber to the fan. This creates a negative pressure below the conveyor which assists in retaining light or flimsy sheets on the conveyor at entry to the plenum chamber.

The conveyor belt 7 is adjustable between the (full line) position shown at 7 and an upper (dotted) position 7*a* which is closer to the underside of the plenum chamber.

The centrifugal fan 2 is driven by an electric motor 9 through a variable speed coupling 10 by means of which the rotational speed of the fan can be varied. This governs the mass rate of flow of air supplied to the plenum chamber and this in turn governs the velocity of air emerging from the chamber and impinging on the web or sheets being dried.

Figure 3:
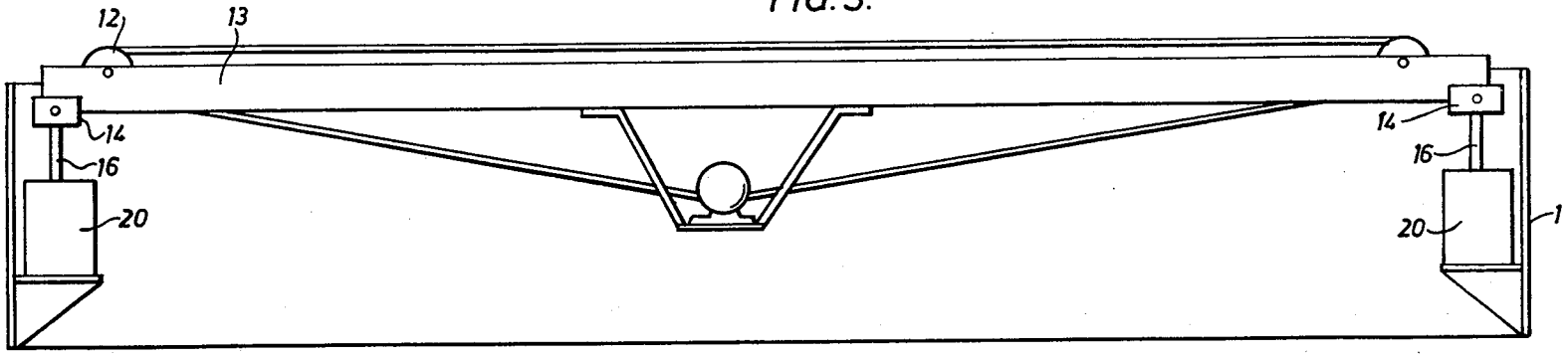
FIGS. 3 and 4 show details of a hydraulic system for raising and lowering the conveyor.
Figure 4:
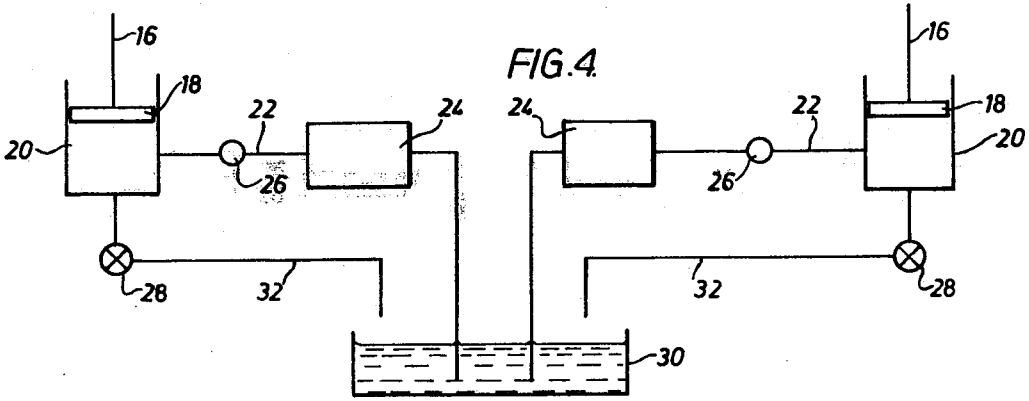

Adjustment of the position of the conveyor may be achieved in any one of a number of ways. FIGS. 3 and 4 show a hydraulic system for raising or lowering one or both ends of a conveyor 12. Each end of a frame 13 supporting the conveyor 12, is pivotally mounted in a yoke 14 to facilitate the raising or lowering of one end only of the conveyor 10. Each yoke is attached to a piston rod 16 connected to a piston 18 slidable in a cylinder 20.

Fluid under pressure is supplied to the cylinder 20 along a supply pipe 22 from a hydraulic pump 24 which may be electrically or manually operated and a back pressure valve 2 ensured that fluid in the cylinder does not seep back through the supply pipe 22. Thus, the conveyor 12 is raised by pumping fluid into the cylinder 20.

On opening an exhaust valve 28 the weight of the conveyor is sufficient to displace the piston 18 and to thereby transfer fluid from the cylinder 20 to the reservoir 30 along the outlet pipe 32. In this way the conveyor may be lowered to a desired position.

In FIG. 1 the conveyor is mounted upon pivotal links 34 which may be automatically or manually operated to raise or lower the conveyor.

Figure 5:
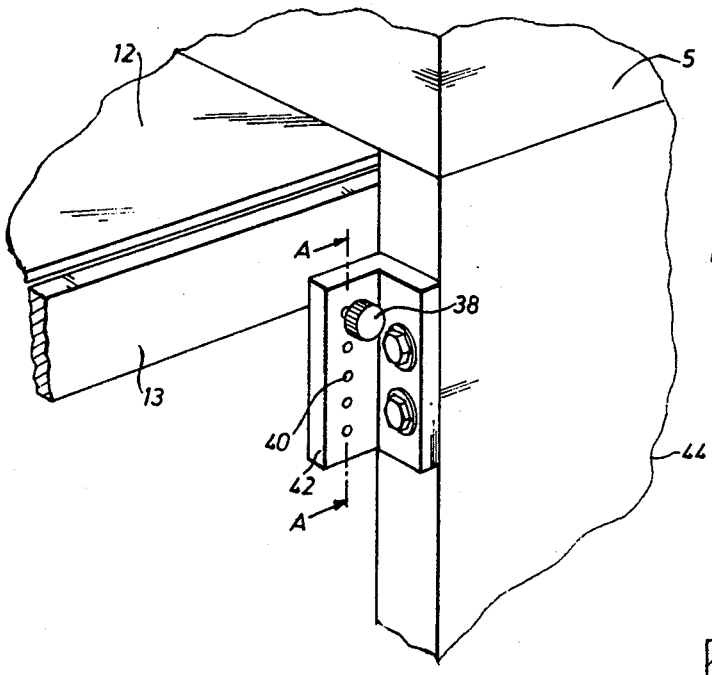
FIG. 5 shows an adjustable support means for the conveyor.

FIG. 5 shows a conveyor 12 mounted in a Frame 13 and passing beneath a plenum chamber 5. The frame 13 is supported upon two (one shown) stops or pegs 38 passing through one of a series of holes 40 formed in a bracket 42 attached to supporting structure 44.

Figure 6:
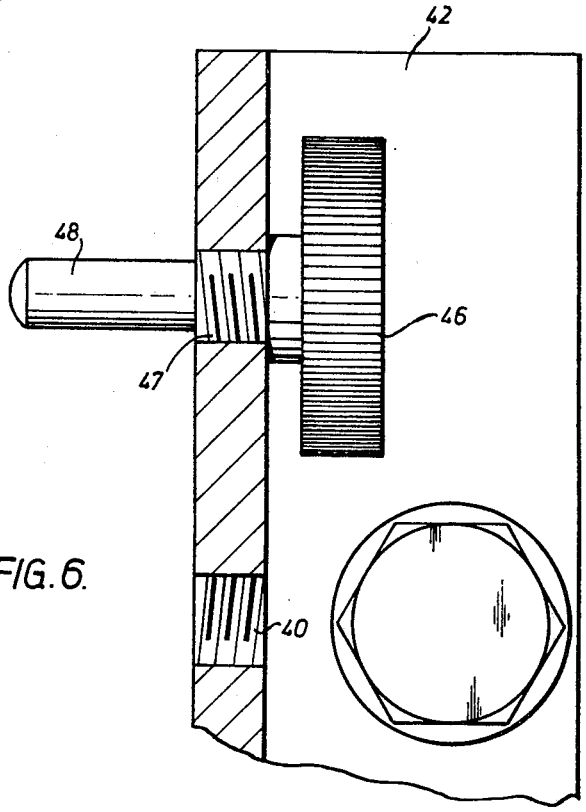
FIG. 6 shows a cross-section on AA in FIG. 5.

The stop or peg 38 is formed with a hand nut 46, a screwed threaded portion 47 and portion 48 upon which the frame 13 is supported, (FIG. 6). The stop or peg is screwed into a hole in the bracket and is thereby retained in the hole.

Such an arrangement may be provided at entry to and/or exit from the plenum chamber.

To adjust the height of one or each end of the conveyor it is necessary simply to remove the stops or pegs from one pair of holes corresponding to a particular height and place the pegs in another pair of holes corresponding to a different height. Counter balance-weights or springs may be used to reduce the effective weight of the conveyor and thereby assist manual raising of the conveyor.

What we claim is:

1. An air jet drying machine comprising a fixed plenum chamber including in a wall thereof one or more apertures, means for supporting an article to be dried adjacent the plenum chamber, means for issuing air from the aperture or apertures to impinge upon such article, a fixed exhaust chamber positioned to receive air after it has issued from the plenum chamber and has impinged on said article, said support means comprising an endless conveyor belt wherein both runs are positioned between the plenum chamber and the exhaust chamber, said fixed exhaust chamber including exhaust means for maintaining a pressure differential across said conveyor to hold articles on said conveyor, and means for moving said conveyor belt towards or away from said plenum chamber to vary the distance therebetween and thus vary the velocity at which air impinges upon the article supported on said conveyor belt.

2. An air jet drying machine according to claim 1 wherein at least one end of the conveyor is supported upon stops on a supporting structure, the position of the stops being adjustable.

3. An air jet drying machine according to claim 2 including at least one series of holes formed in the supporting structure and a corresponding number of pegs constituting the said support to permit raising and lowering the conveyor by removing the peg or pegs from one hole or set of holes corresponding to a particular height and placing the peg or pegs in another hole or set of holes corresponding to a different height.

4. An air jet drying machine according to claim 1 and including means for raising and lowering at least one end of the conveyor.

5. An air jet drying machine according to claim 1 including counter balance weights or springs to reduce the effective weight of the conveyor.

* * * * *

UNITED STATES PATENT OFFICE

CERTIFICATE OF CORRECTION

Patent No. 3,946,501 Dated March 30, 1976

Inventor(s) Jeffrey Cotterell

It is certified that error appears in the above-identified patent and that said Letters Patent are hereby corrected as shown below:

In the heading the following should be included after portion [21]:

--[30] Foreign Application Priority Data
February 10, 1971 Great Britain.....4386/71--

Signed and Sealed this

Third Day of August 1976

[SEAL]

*Attest:*

RUTH C. MASON
*Attesting Officer*

C. MARSHALL DANN
*Commissioner of Patents and Trademarks*